US009835411B2

(12) United States Patent
Larson, Jr. et al.

(10) Patent No.: US 9,835,411 B2
(45) Date of Patent: Dec. 5, 2017

(54) INTEGRATED RAIL AND SIGHT SYSTEM FOR FIREARM

(71) Applicant: Rock River Arms, Inc., Colona, IL (US)

(72) Inventors: Lester C. Larson, Jr., Colona, IL (US); Kim McCubbin, Colona, IL (US); Tom McCubbin, Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 0 days.

(21) Appl. No.: 14/994,937

(22) Filed: Jan. 13, 2016

(65) Prior Publication Data

US 2016/0209166 A1 Jul. 21, 2016

Related U.S. Application Data

(60) Provisional application No. 62/103,875, filed on Jan. 15, 2015.

(51) Int. Cl.

| | |
|---|---|
| ***F41G 1/033*** | (2006.01) |
| ***F41G 11/00*** | (2006.01) |
| ***F41A 3/72*** | (2006.01) |
| ***F41A 35/06*** | (2006.01) |
| ***F41G 1/08*** | (2006.01) |
| ***F41G 1/17*** | (2006.01) |
| ***F41G 1/26*** | (2006.01) |

(52) U.S. Cl.

CPC ..... *F41G 1/033* (2013.01); *F41A 3/72* (2013.01); *F41A 35/06* (2013.01); *F41G 1/08* (2013.01); *F41G 1/17* (2013.01); *F41G 1/26* (2013.01); *F41G 11/003* (2013.01)

(58) Field of Classification Search

CPC . F41G 1/16; F41G 1/17; F41G 11/003; F41A 3/72

USPC ..... 42/124, 127, 148, 125, 140, 128, 87; 89/1.4

See application file for complete search history.

(56) References Cited

U.S. PATENT DOCUMENTS

| | | | | |
|---|---|---|---|---|
| 5,533,292 | A | 7/1996 | Swan | |
| 6,490,822 | B1 * | 12/2002 | Swan | F41C 23/00 42/124 |
| 7,685,758 | B2 | 3/2010 | Romer | |
| D637,678 | S * | 5/2011 | Larson | D22/103 |
| 8,375,619 | B2 | 2/2013 | Hewes | |
| 8,561,517 | B2 * | 10/2013 | Brown | F41A 3/72 89/1.4 |
| 2009/0049734 | A1 * | 2/2009 | Storch | F41G 1/18 42/136 |

(Continued)

*Primary Examiner* — Reginald Tillman, Jr.
(74) *Attorney, Agent, or Firm* — Banner & Witcoff, Ltd.

(57) ABSTRACT

A firearm includes an integrated rail and sight system that slidably mounts to the top of the firearm and is also retractable and detachable from the firearm. The rail may slide on and off the top of the firearm and may include integrated front and rear flip down sights. Both sights are pinned to the rail and can fold down to the rail such that they are flush with or seat below the top portion of the rail. This permits accessories to be mounted to the rail without the sights interfering with the mounting of the accessories or without the sights interfering with the operation of the accessories. The firearm further includes an ambidextrous charging handle mounted through the integrated rail and sight system.

19 Claims, 17 Drawing Sheets

(56) References Cited

U.S. PATENT DOCUMENTS

| | | | | |
|---|---|---|---|---|
| 2011/0308132 | A1* | 12/2011 | Hewes | F41G 1/033 42/135 |
| 2012/0102803 | A1 | 5/2012 | Troy et al. | |
| 2013/0160345 | A1* | 6/2013 | Li | F41G 11/003 42/124 |

* cited by examiner

INTEGRATED RAIL AND SIGHT SYSTEM FOR FIREARM

CROSS REFERENCE TO RELATED APPLICATION

This application claims priority to U.S. Provisional Application Ser. No. 62/103,875, filed Jan. 15, 2015, which is incorporated herein by reference.

TECHNICAL FIELD

The present invention relates generally to firearms and, more particularly, to an integrated rail and sight system for a firearm that is detachable from the firearm.

BACKGROUND

The use of rails, such as Picatinny rails, on firearms is known. Such rails are used to mount optics, lights, lasers and other accessories. The use of aiming sights that are mounted to the top of the rails are also known.

A known drawback with existing rails and sights is the lack of interchangeability on a firearm. Typically, the rails are formed part of the upper receiver or upper portion of the firearm and cannot be removed or interchanged. Additionally, depending on the desired sights to be used on the firearm, to change out the sights, the mounted sights need to be removed from the rail and replacements mounted to the rail. Such changing of sights can be complicated and/or time consuming.

The present invention seeks to overcome these limitations and other drawbacks of the prior art, and to provide new features not heretofore available.

BRIEF SUMMARY

The present invention relates generally to a firearm that includes a detachable integrated rail and sight system. The invention may be used with a rifle, carbine, pistol, handgun, shotgun, air gun, long gun and the like. The rail of the invention slidably mounts to the top of the firearm and is also retractable and detachable from the firearm. In other words, the rail may slide on and off the top of the firearm in a manner described by the invention. The rail of the invention also includes integrated front and rear flip-down sights. Both sights may be pinned to the rail and can fold down to the rail such that they are flush with or seat below the top portion of the rail. This permits accessories to be mounted to the rail without the sights interfering with the mounting of the accessories or without the sights interfering with the operation of the accessories. Mounted to the flip-down sights are detachable tri-apertures. The tri-apertures include three different sized apertures that rotate around a central axis. The entire aperture assembly is detachable from the sight. The rail may also accommodate an ambidextrous side-charging handle assembly for charging the bolt assembly. The ambidextrous charging handle assembly may slidably mount to the upper receiver and between the upper receiver and the underside of the integrated rail and sight assembly. The handles of the charging handle assembly may extend through elongated slots or apertures formed in the side walls of the integrated rail and sight assembly.

Other features and advantages of the invention will be apparent from the following specification taken in conjunction with the following drawings.

DESCRIPTION OF THE EMBODIMENTS

Figure 1:
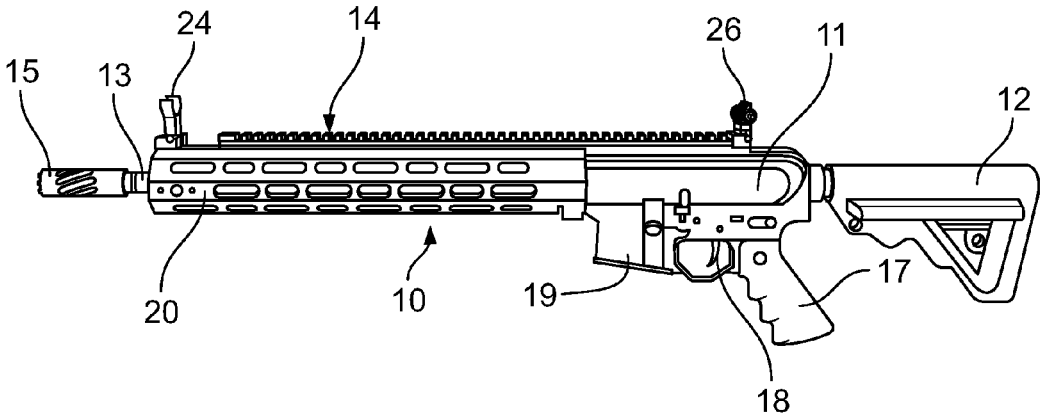
FIG. 1 is a side view of an exemplary firearm incorporating embodiments of the invention.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

FIG. 1 illustrates an example of a firearm 10 that may be used in connection with aspects of the present invention. The firearm 10 may be in the form of a tactical style rifle, such as an AR-15, M-16, M-4, etc. The firearm 10 generally includes a receiver assembly 11 defining an upper receiver and a lower receiver, a buttstock 12 connected to the rear of the receiver assembly 11, a barrel 13 connected to the front of the receiver assembly 11, and a forearm or forestock 20 (which may also be referred to as a "handguard" in the art). The receiver assembly 11 may include a firing mechanism and other components known in the art, such as a bolt, a bolt carrier, firing pin, etc. The barrel 13 in this embodiment is a free-floating barrel that is connected to the receiver assembly 11 and is supported by the connection to the receiver assembly. A different type of barrel 13 may be used in other embodiments. The barrel 13 has a muzzle 15 at the tip. The muzzle may include a muzzle brake, sound compensator or flash hider.

The forearm or handguard 20 may be connected to the barrel 13 and/or the receiver assembly 11 and cover a portion of the length of the barrel 13 between the receiver assembly 11 and the muzzle 15. In one embodiment, the forearm or handguard 20 connects to the firearm 10 proximate the receiver assembly, at the rear end of the barrel 13, using a threaded connection with threading inside the forearm 20. In another embodiment, the forearm may be attached to the receiver through the use of fasteners. In another embodiment, the forearm 20 may not completely cover the barrel 13, and, for example, may cover or be positioned adjacent one or more sides of the barrel 13. The firearm 10 may also include other known components, such as a grip 17, a trigger 18, a magazine well 19 for holding a magazine (not shown), and/or other firearm components. It is understood that the firearm 10 may not include one or more of such components in other embodiments. Aspects of the invention may be utilized in connection with a firearm 10 as illustrated in FIG. 1 or another type of firearm, including other types of rifles, carbines, pistols, handguns, shotguns, machine pistols, air rifles, paintball guns, or other firearms.

Figure 2:
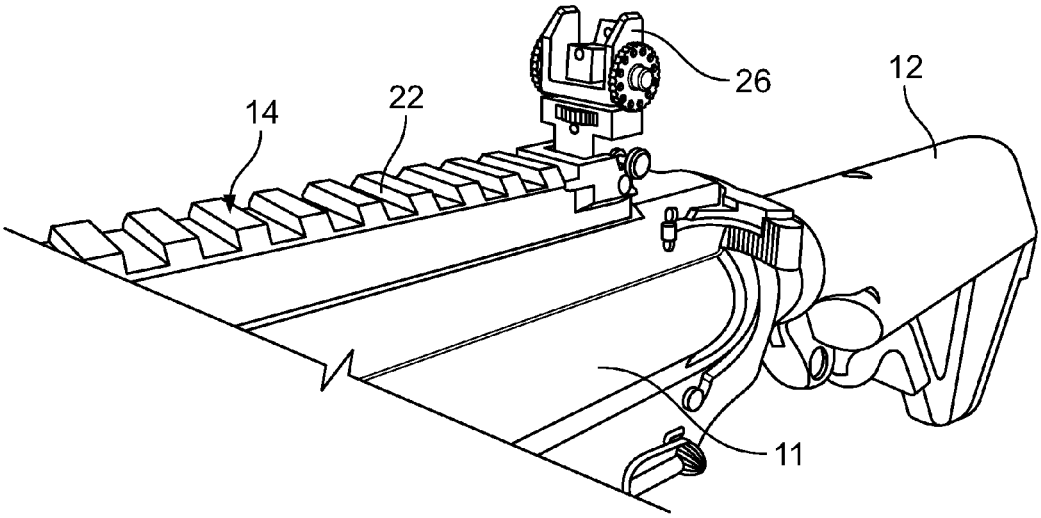
FIG. 2 is a partial perspective view of one embodiment of an integrated rail and sight system of the invention.
Figure 3:
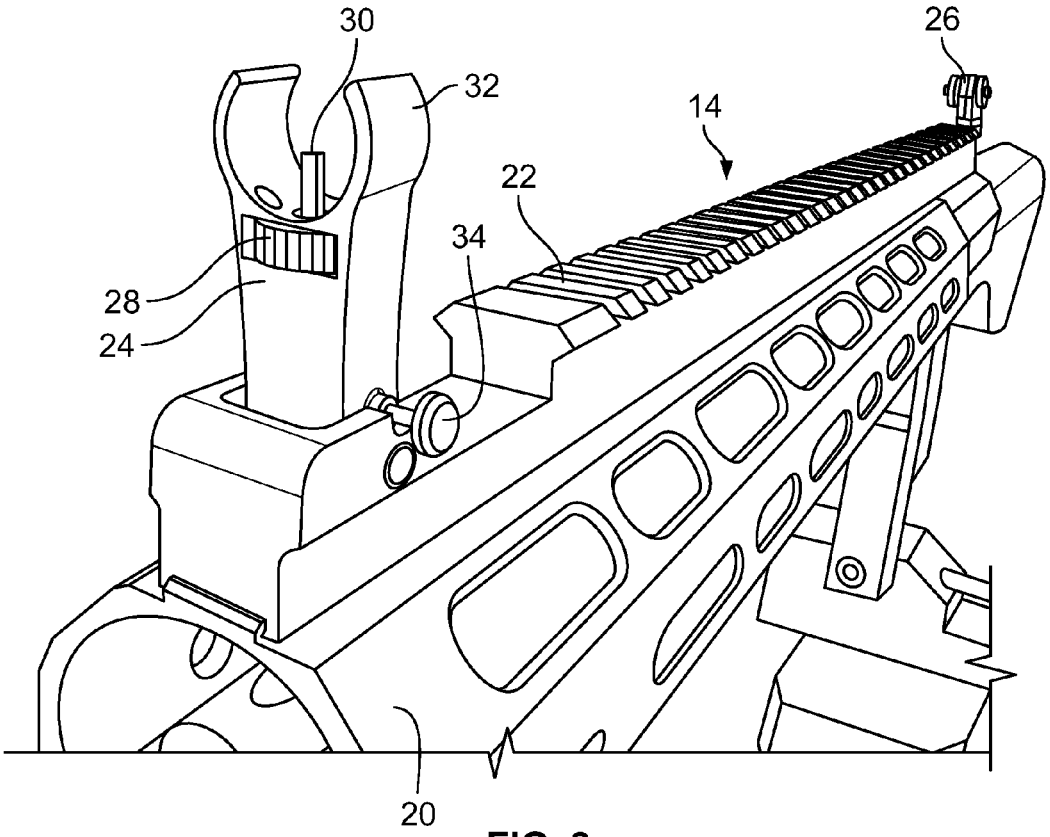
FIG. 3 is another partial perspective view of one embodiment of an integrated rail and sight system of the invention.

In the embodiments, the firearm 10 may have a detachable integrated rail and sight assembly 14 of the invention. Referring to FIGS. 2 and 3, the integrated rail and sight assembly 14 incorporates an elongated rail 22, and a flip-down front sight 24 and a flip-down rear sight 26 both of which are integrated with the rail 22. The rail 22 is configured for mounting of accessories. The rail 22 illustrated in this embodiment is a Picatinny rail, but other types or configurations of rails may be used in other embodiments. Examples of accessories that may be mounted on the rail of the firearm 10 may include, without limitation: sights, including fixed sights, adjustable sights, laser sights and reflex sights; scopes, night vision, or other optical equipment; grips or handles; auxiliary weapons; bipods, tripods, or other support devices. It is understood that multiple accessories may be mounted on the rail.

Referring to FIGS. 2 and 3, in one aspect of the integrated rail and sight assembly, the front sight 24 and rear sight 26 are shown in a flipped up position on the rail 22. In other embodiments, one or both of the sights may be moved to a flipped down position. As described in further detail below, the rear sight 26 may include an elevation knob for adjusting the height of the rear sight. The rear sight 26 may further include an ambidextrous windage knob for adjusting the rear sight in a lateral direction to account for wind conditions. The windage knobs adjust a windage box onto which mounts a tri-aperture, as described in more detail below. The tri-aperture includes three different sized apertures or openings through which the operator lines up or aims the rifle. A different sized aperture may be desired by the operator depending on the operator's preference, the caliber of the firearm and the type of ammunition used. The tri-aperture is detachably mounted to the windage box. This allows the tri-aperture to be removed and other apertures to be mounted to the rear sight.

Figure 4:
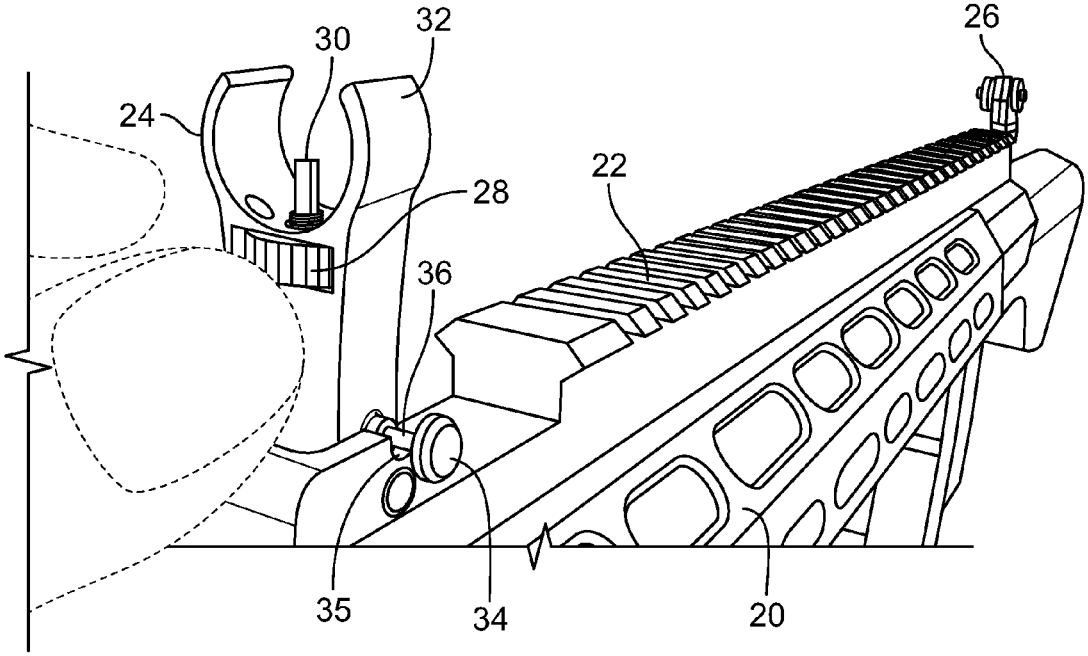
FIG. 4 is another partial perspective view of one embodiment of an integrated rail and sight system of the invention.

Referring to FIG. 4, there is depicted the front sight 24 flipped up from the rail 22. The front sight 24 includes an elevation knob 28 for adjusting the height of a sight post 30. The sight post is used to align the firearm at a target. The sight post is positioned between two opposing arc-shaped sight portions 32 that are designed to assist the operator in quickly aligning and sighting the rifle on the desired target. As depicted, an operator may adjust the vertical height of the sight post 30 by turning the elevation knob which will raise or lower the height or location of the sight post on the front sight. In an aspect of the invention, the front sight 24 may include a plunger pin 34 that is used to releasably flip up or flip down the front sight. The plunger pin is spring loaded, as described below. In other embodiments, the front sight might not include an elevation knob or other means to adjust the front sight post.

Figure 5:
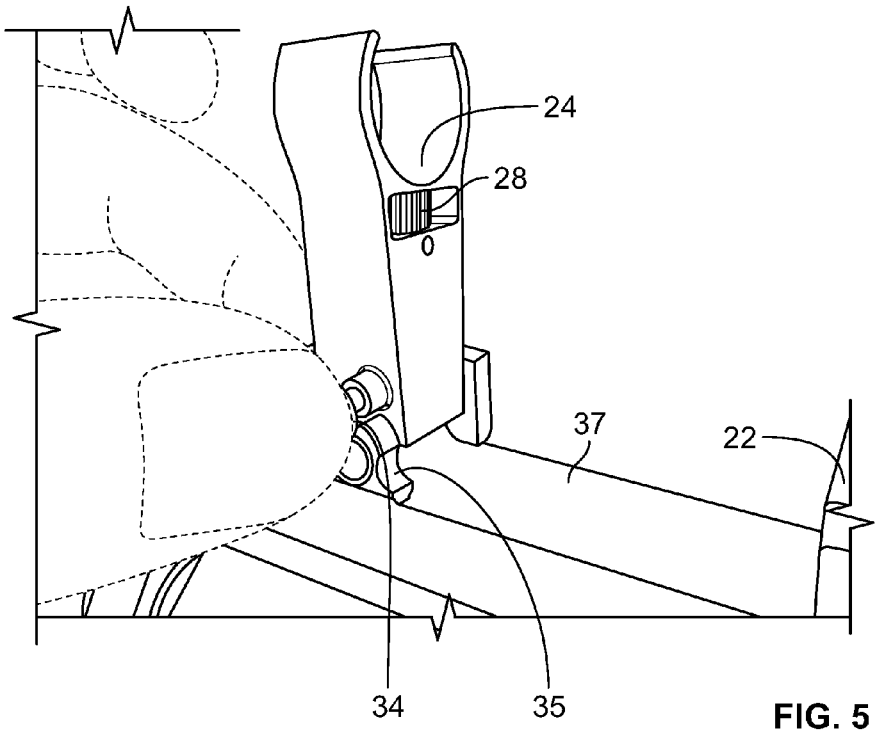
FIG. 5 is a close-up partial perspective view of one embodiment of an integrated rail and sight system of the invention.
Figure 7:
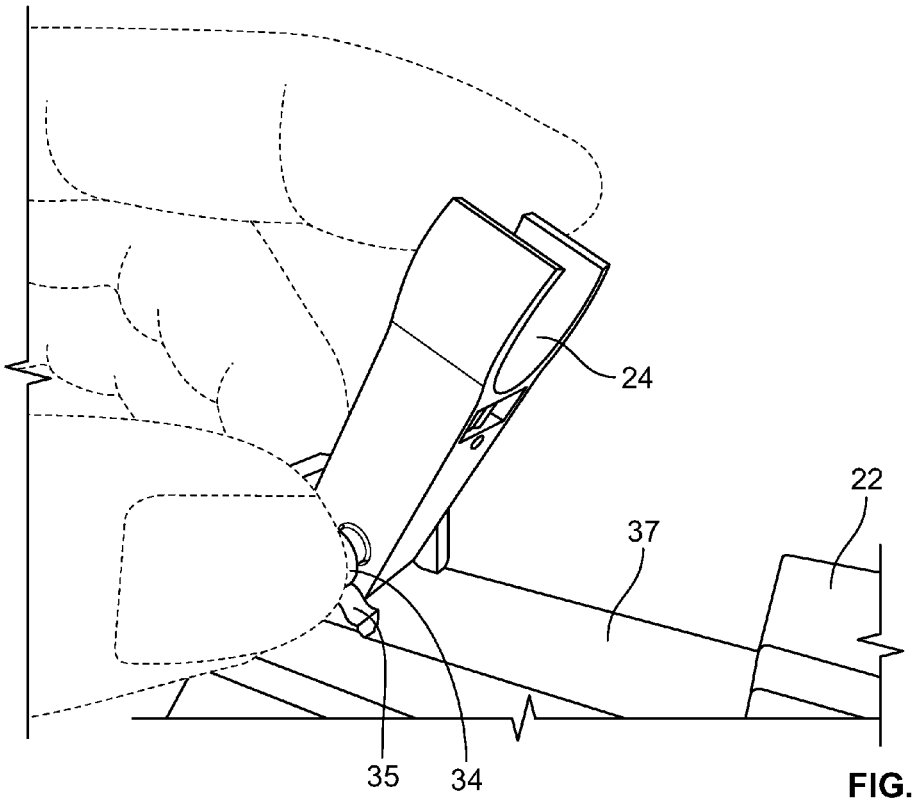
FIG. 7 is another close-up partial perspective view of one embodiment of an integrated rail and sight system of the invention.

Referring to FIG. 5, the front sight may be moved from a flipped up position (shown in FIG. 5) toward a flipped down position (as shown in FIG. 7). In one embodiment, the operator may press plunger 34, which incorporates a plunger spring 79, which releases the sight from its flipped up position, and then rotate the front sight toward the flipped down position where the front sight will be positioned against the rail 22 and will seat flush with or slightly below the top portion of the rail. Once in this position, the plunger 34 will seat within a half-moon shaped support portion 35 of the front sight thereby holding the front sight in the flipped down position.

Figure 6:
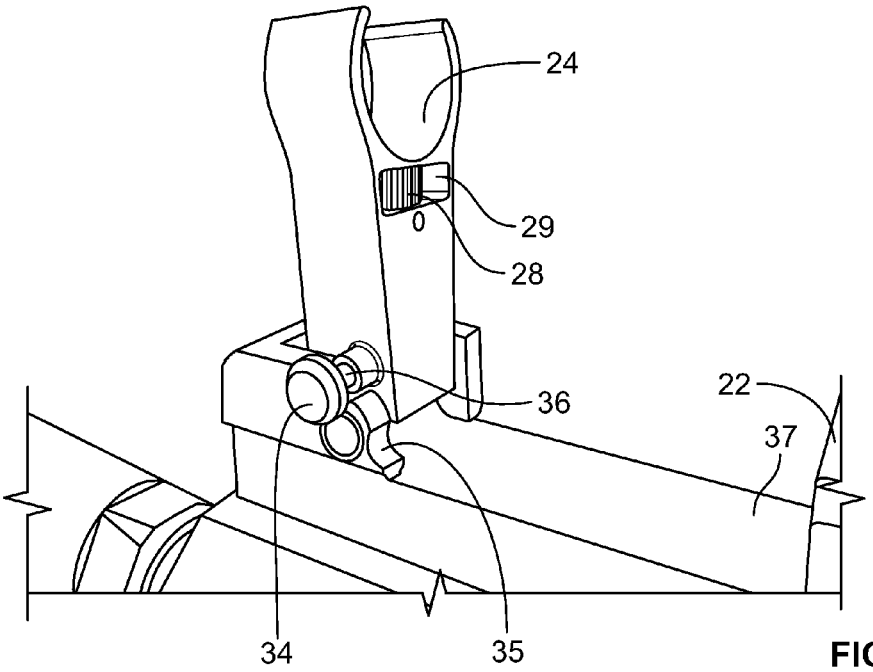
FIG. 6 is another close-up partial perspective view of one embodiment of an integrated rail and sight system of the invention.

Referring to FIG. 6, the elevation knob 28 is designed to be recessed within an opening 29 formed in the front sight. By recessing the elevation knob 28, the front sight can flip down completely and seat flat against the rail surface 37. In other embodiments, the elevation knob 28 is not completely recessed within the opening 29. The knob 28 may define vertical ribs or a knurled surface on the outer surface of the knob to provide a gripping surface for the operator.

Referring to FIG. 7, the operator may press the plunger 34, which is actuated by the internal spring 79, and with the use of an index finger may move the front sight toward the flipped down position. Once the plunger 34 is pressed and the front sight is rotated approximately 22.5 degrees, the operator may release the spring operated plunger 34 which will then move outwardly due to the spring force acting on the plunger. The front sight 24 will still be able to rotate toward the flipped down position until the plunger seats within the half-moon shaped portion 35 of the front sight. At this position, the front sight will be held in the flipped down position by the plunger acting on the half-moon shaped portion 35 and the front sight will lay flat against the rail surface 37.

Figure 8:
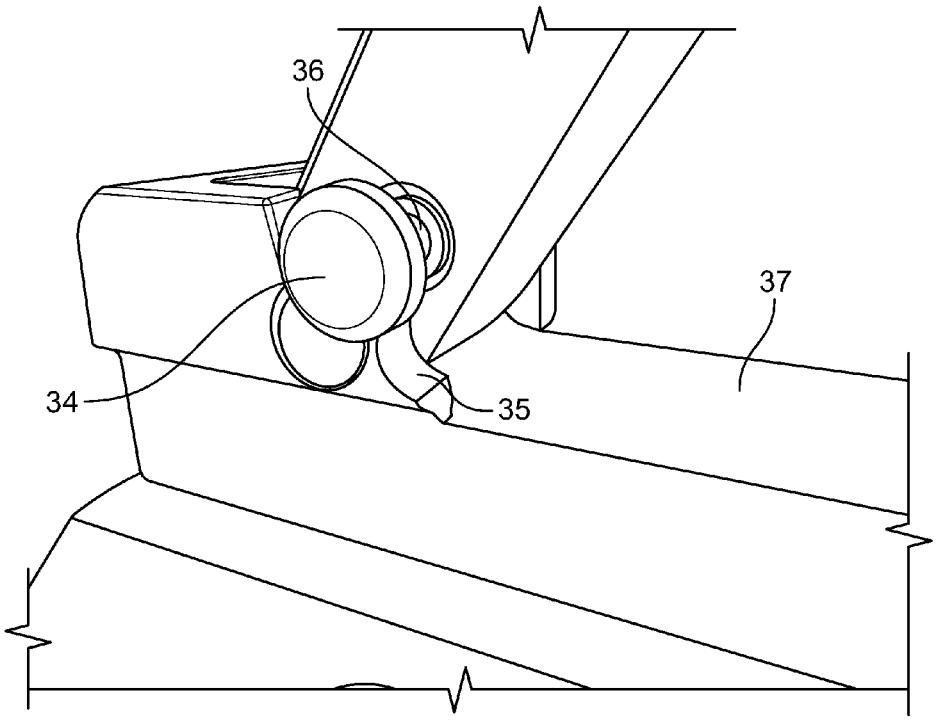
FIG. 8 is a close-up partial perspective view of an exemplary front sight of the invention.

Referring to FIG. 8, there is depicted a close-up view of the plunger 34 and the half-moon shaped portion 35. As depicted, the half-moon shaped portion defines a radius that substantially matches the radius of the plunger pin 36. This configuration permits the plunger 34 to suitably seat within the half-moon shaped portion 35.

Figure 10:
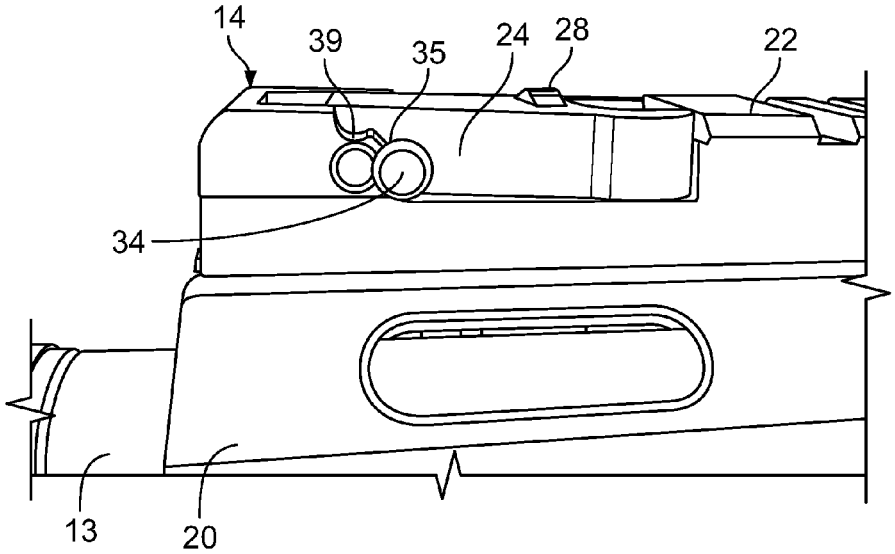
FIG. 10 is a close-up partial side view of one embodiment of an integrated rail and sight system of the invention.

Referring to FIG. 10, the front sight 24 is depicted in a fully flipped down position within the rail 22. As can be seen, the front sight 24 will seat flush with or slightly below the top portion of the rail 22. This will allow accessories to be placed on the rail 22 without the front sight interfering with the installation or operation of the accessories. As depicted, the plunger 34 seats within the half-moon shaped portion 35 to thereby hold the front sight 24 in the flipped-down position. Also depicted in FIG. 10 is a second half-moon shaped portion 39 located on the front sight 24. The second half-moon shaped portion 39 is sized and shaped to receive the plunger pin 36 when the front sight 24 is moved to the flipped up position. The portion 39 serves as a seat for the plunger pin 36 to hold the pin and consequently the front sight in the flipped up position.

Figure 9:
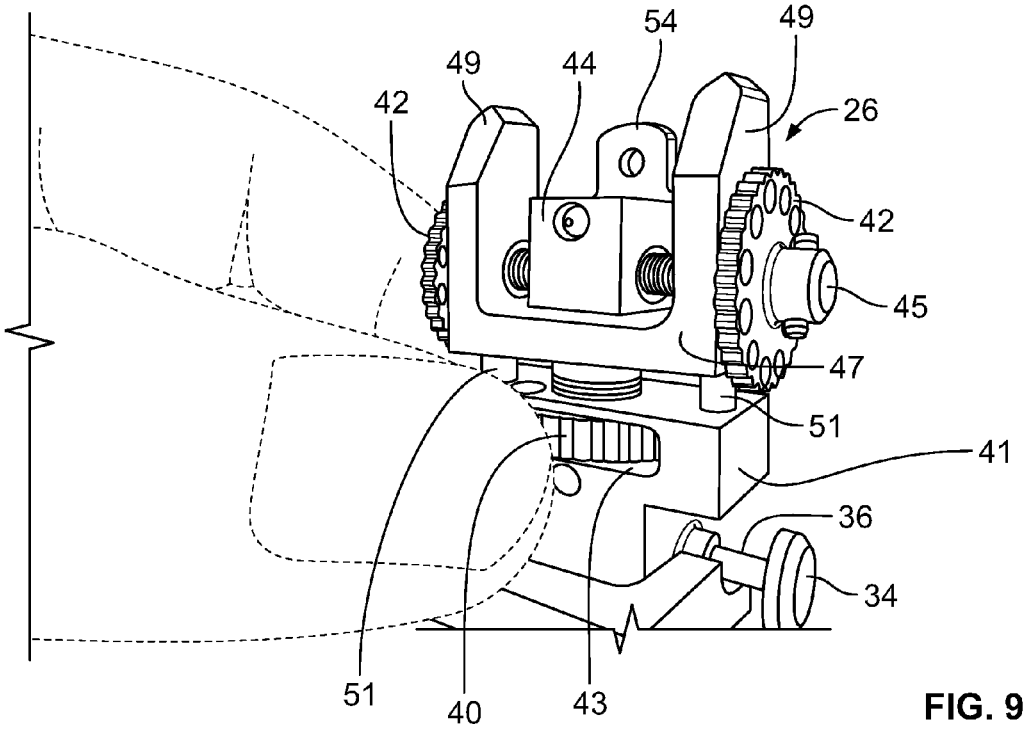
FIG. 9 is a close-up perspective view of an exemplary rear sight of the invention.

Referring to FIG. 9, there is depicted an exemplary embodiment of the rear sight 26. In one embodiment, the rear sight may include an elevation knob 40 for adjusting the height of the rear sight. The elevation knob is positioned within an elevation body 41 and is accessible through an opening 43 formed in the elevation body. The rear sight 26 may also include ambidextrous windage knobs 42 for adjusting the rear sight in a lateral direction to account for wind conditions. The windage knobs 42 define two opposing wheels that operatively connect to and adjust a windage box 44. This is accomplished through a threaded pin 45 that extends between and joins the wheels to the windage box. By turning either of the wheels in either a clockwise or counter-clockwise direction, the threaded pin extending through the windage box will move the windage box laterally or side to side. This results in the sight aperture mounted to the windage box to be moved laterally to account for wind conditions. The windage knobs 42 are ambidextrous because at least one knob 42 is accessible from either the right side or left side of the firearm, thereby permitting the operator to adjust the rear sight with either a left hand or a right hand.

The windage wheels, pin, and windage box are all mounted and held together through a windage base 47. The windage base also includes opposing and vertically extending brackets 49 that each define a hole for supporting the pin 45. Connecting the windage base 47 to the elevation body 41 are vertically extending elevation pins 51. In one embodiment, two elevation pins operatively join the windage base 47 to the elevation body 41 and permit the vertical movement of the windage base relative to the elevation body. The pins 51 also keep the windage base from twisting relative to the elevation body. This permits the windage base to be held in place more securely thus improving the integrity of the rear sight and thus the accuracy of the firearm.

Figure 11:
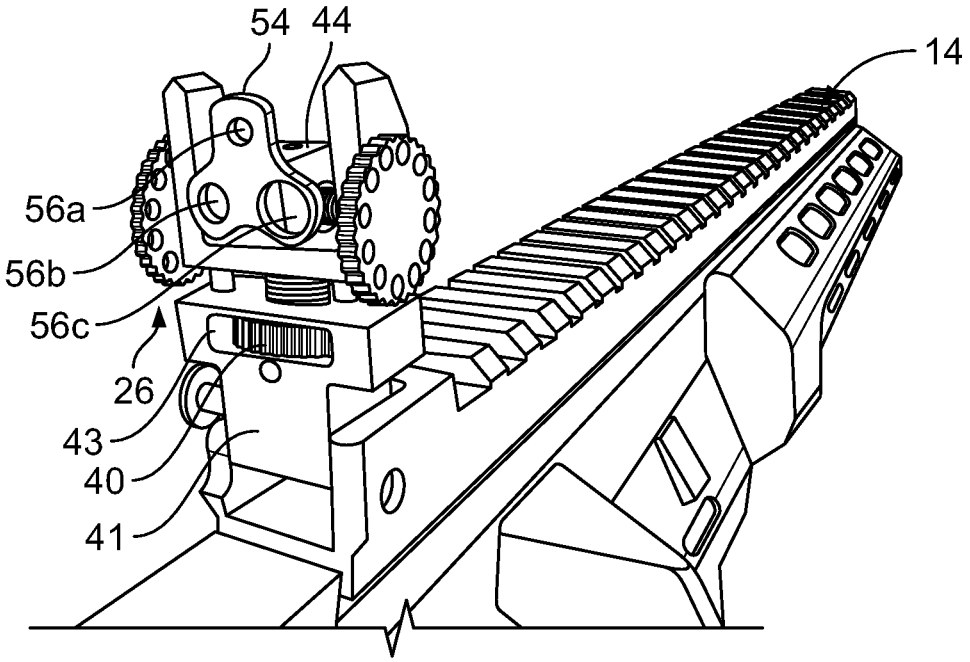
FIG. 11 is a close-up perspective view of an exemplary rear sight of the invention.

As shown in FIG. 11, mounted to the windage box is a tri-aperture 54. The tri-aperture includes three different sized apertures 56*a*, 56*b*, 56*c*, or openings through which the operator lines up or aims the rifle. The tri-apertures rotate around a central axis so as to permit the operator to change the aperture from one size to another. In an exemplary embodiment, the tri-aperture is detachably mounted to the windage box 44. This allows the tri-aperture to be removed and other apertures to be mounted to the rear sight 26.

Figure 12:
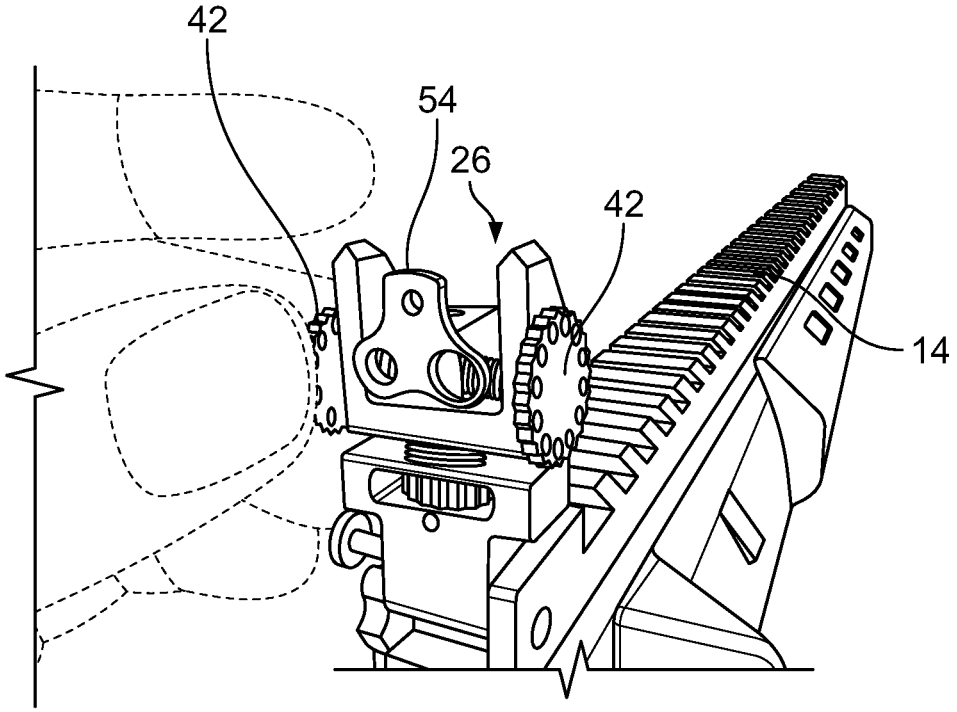
FIG. 12 is a close-up perspective view of an exemplary rear sight of the invention.

Referring to FIG. 12, the windage knob 42 is shown being adjusted from a left side of the firearm. The opposing windage knob 42 could also be easily adjusted from the right side of the firearm. In an alternative embodiment, the rear sight 26 could provide for only a single windage knob 26. In this embodiment, the windage knob could be located on either the right or left side of the rear sight.

Figure 13:
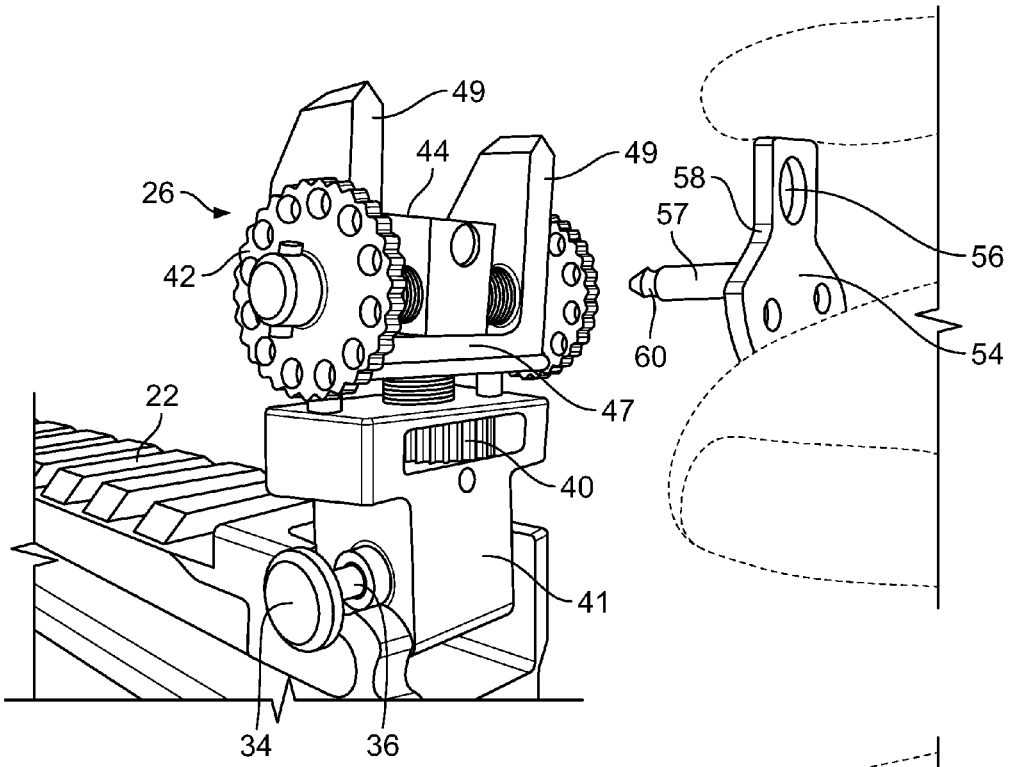
FIG. 13 is a close-up perspective view of an exemplary rear sight of the invention.

Referring to FIG. 13, the tri-aperture 54 may be detachably mounted to the windage box 44. This allows the tri-aperture to be removed and remounted or other apertures to be mounted to the rear sight 26. The tri-aperture defines a central post 57 extending outwardly from the planar aperture surface 58. The central post may be mounted to the windage box by inserting the central post into an opening in the windage box. Located within the opening and within the windage box may be a spring urged spherical ball bearing. Located on the central post may be three spherical radii 60. The radii may be formed into the post and in a circumferentially spaced-apart relationship. Each radius corresponds to a position on the central post that results in an aperture being positioned in a top most position that is also aligned with the rear sight. The spherical radii are configured to match the radius of the spherical bearing located within the windage box. The spherical radii 60 allow the central post to have a positive lock when rotating through the three positions. In other words, when the spherical bearing seats within a radius 60, the central post is locked in that position. Upon rotating the tri-aperture, the spherical bearing moves out of the radius and will re-seat in the next radius after the tri-aperture is rotated to the next radius. At this point, the central post will be locked again and the next aperture 56 will be positioned in a top most position that is also aligned with the rear sight.

Figure 14:
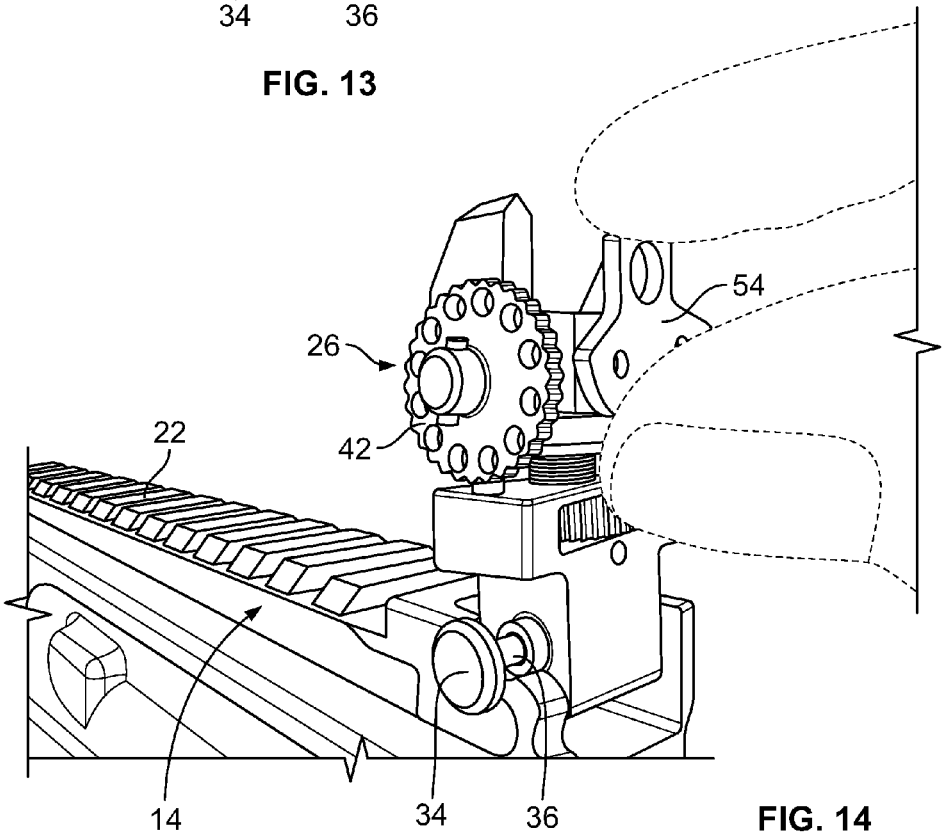
FIG. 14 is a close-up perspective view of an exemplary rear sight of the invention.

Referring to FIG. 14, the tri-aperture 54 may be removed from the windage box by pulling the tri-aperture 54 and post 57 out from the windage box. In one embodiment, the post 57 is held within the windage box with the spherical ball bearing. The spherical ball bearing is spring loaded within the windage box. In other embodiments, the post 57 is held within the windage box using other techniques.

Figure 15:
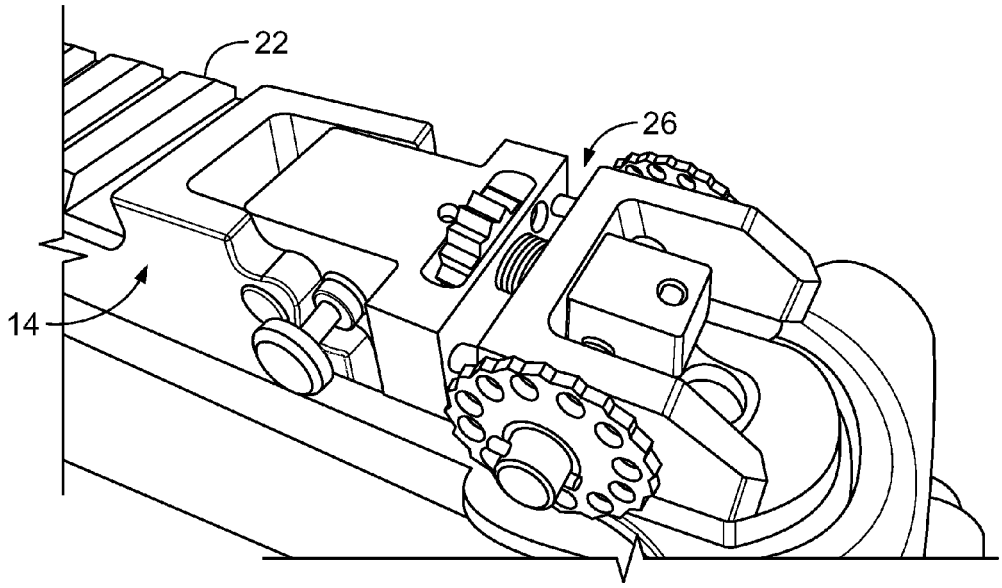
FIG. 15 is a close-up perspective view of an exemplary rear sight of the invention.

Referring to FIG. 15, the rear sight 26 may be flipped down and located flush with or below the rail in the same manner as described above with respect to the front sight. Just like the elevation knob in the front sight, the elevation knob in the rear sight is recessed and offset to permit the rear sight to lay flat with the rail 22. Also, just like the front sight, the rear sight includes a plunger and plunger pin that engages with a half-moon shaped portion when in the flipped down position and also engages with a second half-moon shaped portion when in the flipped up position.

Figure 16:
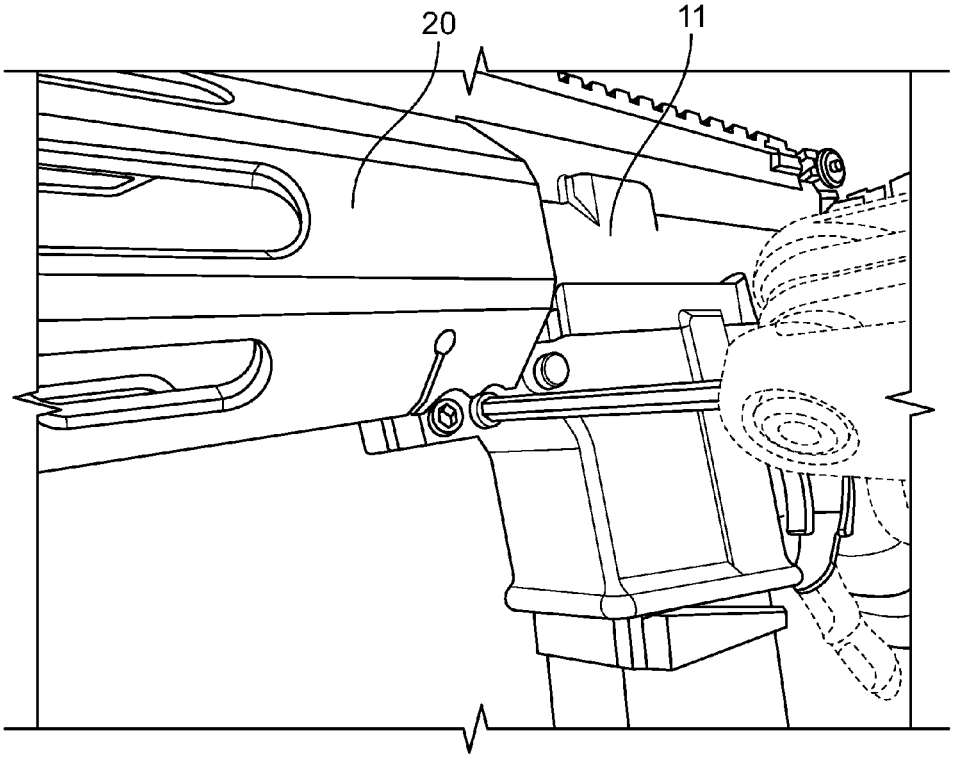
FIG. 16 is a close-up perspective view of an exemplary handguard of the invention.

Referring to FIG. 16, the handguard 20 is depicted mounted around the barrel. the handguard 20 may be removed from the firearm by removing the handguard socket head cap screws used to mount the handguard to the firearm. In one embodiment, the handguard may be made of a metal based material. In other embodiments, the handguard may be made from carbon fiber or from fiberglass. The rail and sight assembly 14 may be mounted to any handguard made of any of these material types.

Figure 17:
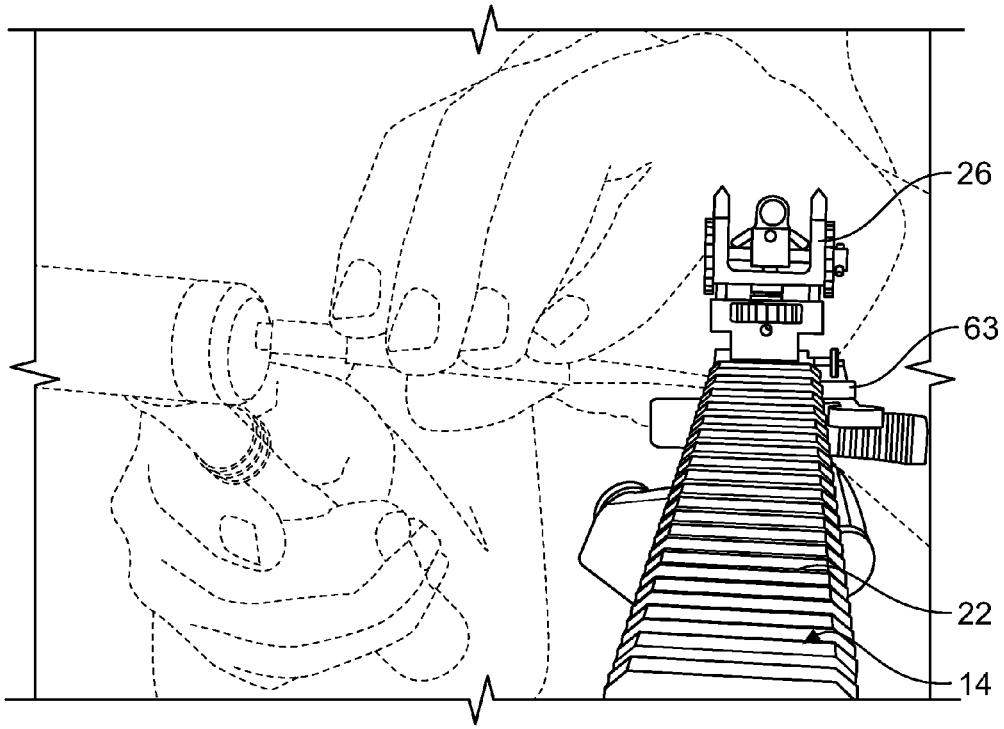
FIG. 17 is a partial perspective view of one embodiment of an integrated rail and sight system of the invention.
Figure 18:
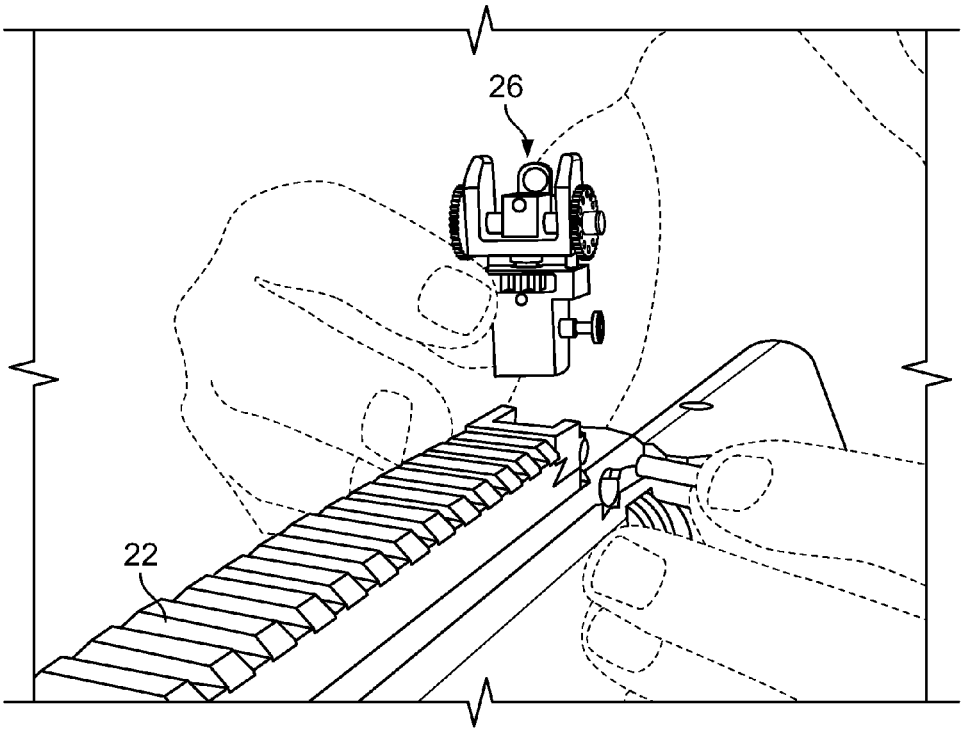
FIG. 18 is a partial perspective view of one embodiment of an integrated rail and sight system of the invention.

Referring to FIGS. 17 and 18, the rear sight 26 is shown being removed from the rail. As depicted, to remove the rear sight, a punch and hammer may be used to remove the pivot pin 63 that connects the rear sight 26 to the rail 22. The rear sight may then be lifted off the rail, as shown in FIG. 18. By removing the pin 63, the rail 22 of the rail and sight assembly may then be slidably removed from the firearm.

Figure 19:
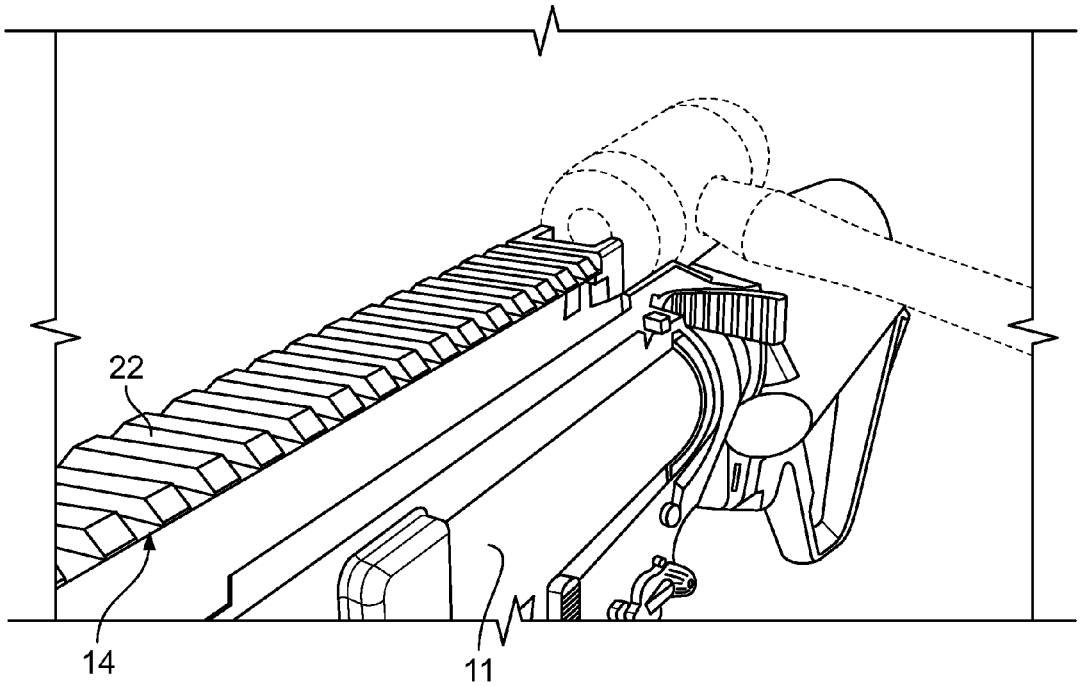
FIG. 19 is a partial perspective view of one embodiment of an integrated rail and sight system of the invention.

Referring to FIGS. 18-24, in an aspect of the invention, the rail 22 of the integrated rail and sight assembly 14 may be slidably removable from the upper receiver of the receiver assembly 11 and the handguard of the firearm. As shown in FIG. 19, once the pin 63 and rear sight 26 are removed, a plastic hammer may be used to tap the rear of the rail 22 to slide it forward. In one embodiment, the rail 22 is slidable toward the front end of the firearm. In other embodiments, the rail 22 may be slidable toward the back end of the firearm. When sliding the rail toward the front end of the firearm, the rail 22 will slide until it is no longer connected to the upper receiver. The rail 22 may slide back on to the upper receiver in the same manner as it was removed.

Figure 20:
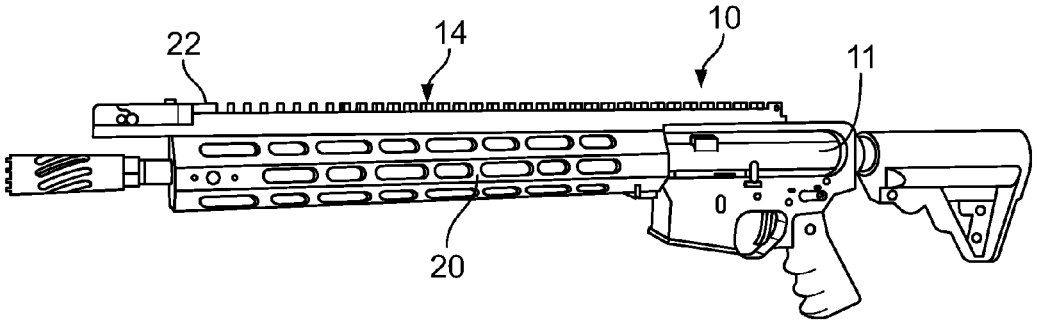
FIG. 20 is a perspective view of one embodiment of an integrated rail and sight system of the invention.

Referring to FIG. 20, the integrated rail and sight assembly 14 is shown partially removed from the receiver assembly 11 and partially removed from the handguard 20. As depicted, the integrated rail and sight assembly 14 is configured to slide across both the receiver assembly 11, which may also have a Picatinny or Weaver rail, and the handguard 20. In other embodiments, for handguards that also include a Picatinny or Weaver rail, the integrated rail and sight assembly 14 is configured to slide across those handguards as well.

Figure 21:
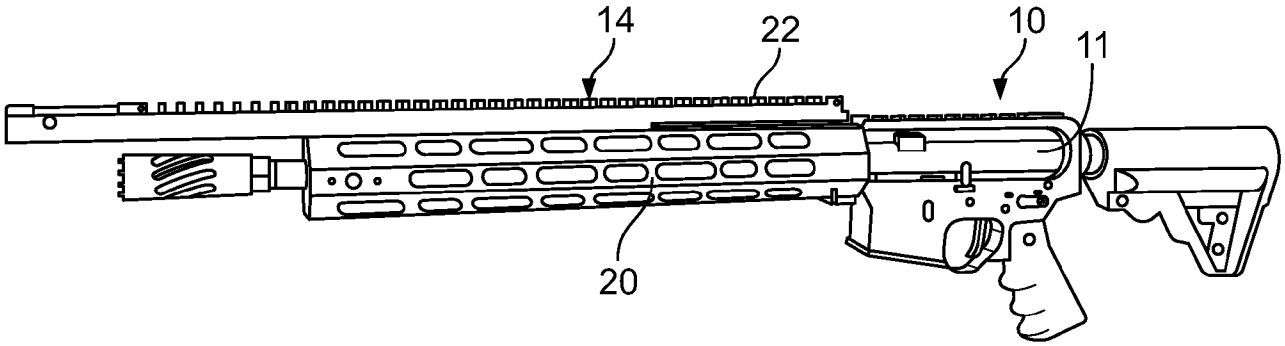
FIG. 21 is a side view of one embodiment of an integrated rail and sight system of the invention.
Figure 22:
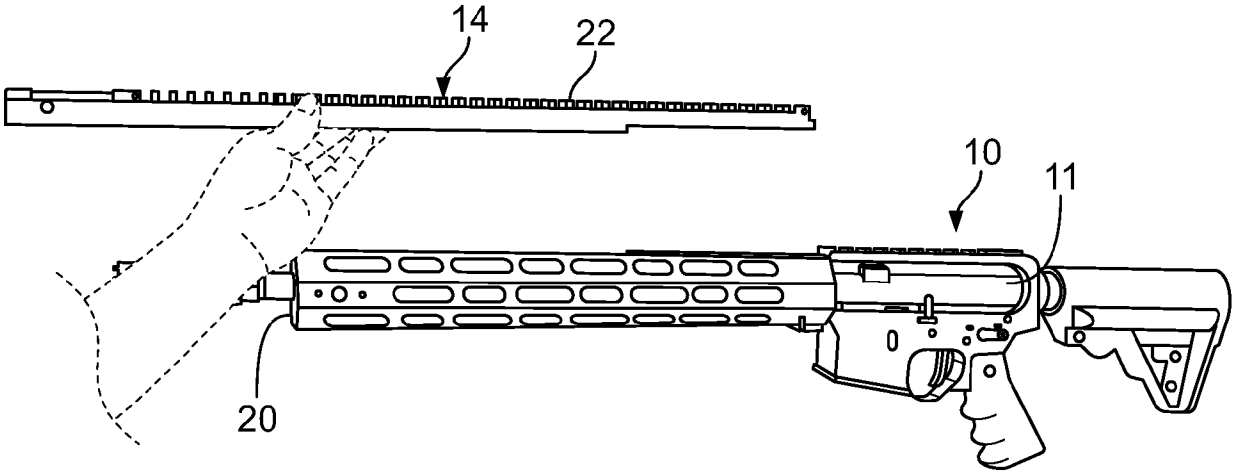
FIG. 22 is a side view of one embodiment of an exemplary integrated rail and sight system removed from an exemplary firearm.

As shown in FIG. 21, the integrated rail and sight assembly 14 is shown removed from the receiver assembly 11. As depicted, the rail 22 of the integrated rail and sight assembly 14 is configured to extend over and slide along the Picatinny rail on the receiver assembly 11. The integrated rail and sight assembly 14 can further slide along the handguard 20 until it is removed from the firearm 10 toward the muzzle end of the firearm. In one embodiment, the rail and sight assembly 14 may be mounted to the top surface of the handguard and/or receiver assembly. In other embodiments, the rail and sight assembly 14 may be mounted to other surfaces of the handguard and/or receiver assembly, including a side surface, to permit the side mounting of the front and/or rear sights.

Significantly, the integrated rail and sight assembly 14 when it is slidably mounted to the handguard and receiver assembly serves the beneficial purpose of aligning the receiver assembly with the handguard. This results in a more precisely aligned firearm because the integrated rail and sight assembly 14 now prevents the handguard from twisting or torqueing relative to the receiver assembly. This also results in a more solid firearm. The firearm will also be more accurate because the integrated rail and sight assembly 14 is a one-piece structure now having a rail located over the receiver assembly and handguard and which will perfectly align the receiver assembly with the handguard. This is in contrast to the standard separate rail on the receiver assembly and a separate rail on the handguard, which might not be perfectly aligned. If the receiver rail and the rail on the handguard are not perfectly aligned there will be inherent accuracy problems between the front sight mounted to the handguard and the rear sight mounted to the receiver assembly. That is, one sight might extend in a slightly different orientation relative to the other sight, thereby creating alignment problems. The present invention eliminates any potential alignment problems between the front and rear sights because of the integral one-piece rail construction that slidably mounts and extends across both the receiver assembly and the handguard.

Figure 23:
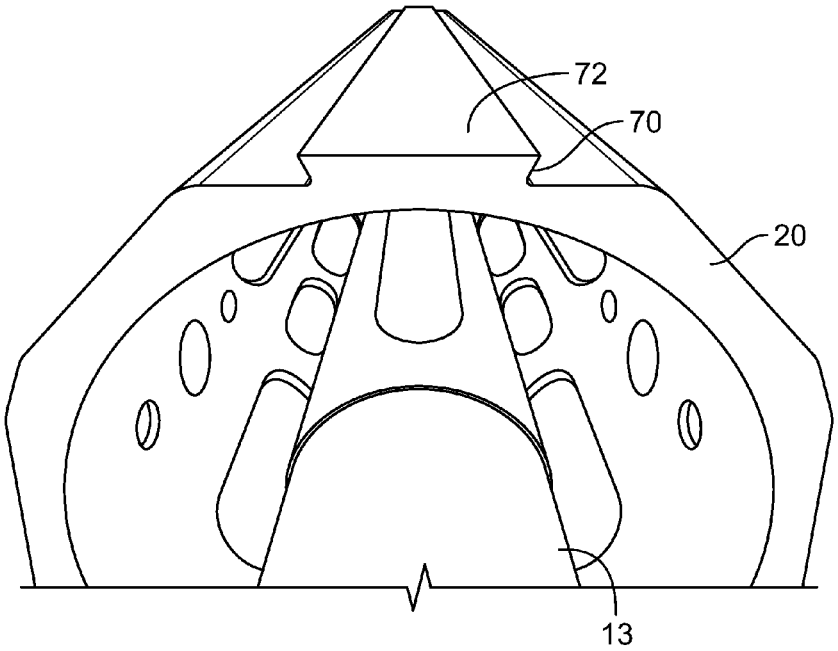
FIG. 23 is a close-up partial perspective view of one embodiment of an exemplary handguard of the invention.

Referring to FIG. 23, in one embodiment, the mating connection between the integrated rail and sight assembly 14 and the handguard and receiver assembly may be a dovetail connection. In other embodiments, the mating connection might be a tongue and groove connection. In yet other embodiments, other mating connections are possible. As depicted in FIG. 23, an elongated dovetail cut 70 may be made to a guide 72 on the handguard 20. The guide 72 and dovetail cut may extend a partial or complete length of the handguard. In other embodiments where the handguard includes a rail, the dovetail cut may be included in the rail. In any of the embodiments, the rail 22 of integrated rail and sight assembly 14 may have a matching dovetail cut on the underside of the rail 22 to permit the rail 22 to engage with and slide along the dovetail cut 70 of the guide 72 or rail, if used. The rail 22 may slide along the guide 72 until the rail is fully mounted onto the firearm at which time the pin 63 may be inserted into opening 87 (shown in FIG. 27) in the receiver assembly 11 and used to secure the rail 22 to the receiver assembly 11 of the firearm.

Figure 24:
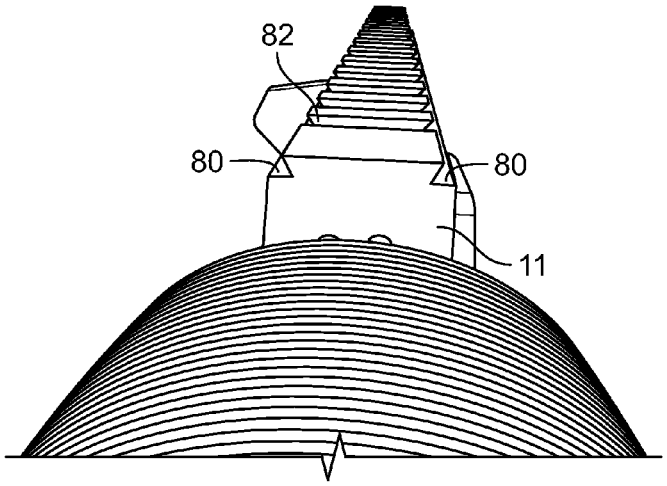
FIG. 24 is a close-up partial perspective view of one embodiment of an exemplary receiver assembly of the invention.

Referring to FIG. 24, in one embodiment, the receiver assembly 11 may include a dovetail cut 80 that may be made to a rail 82 on the receiver assembly 11. In other embodiments, the mating connection might be a tongue and groove connection. In yet other embodiments, other mating connections are possible. The rail 82 and dovetail cut 80 may extend a partial or complete length of the receiver assembly. The rail 22 of the integrated rail and sight assembly 14 may have a matching dovetail cut on the underside of the rail 22 to permit the rail 22 to engage with and slide along the dovetail cut 80 of the rail 82 of the receiver assembly. With this embodiment, when the integrated rail and sight assembly 14 is removed from the receiver assembly, the rail 88 can still be used as a rail to mount accessories to the firearm. The dovetail cut 80 does not impede or prevent the full use of the rail 82 after the rail 22 is removed from the receiver assembly.

Figure 25:
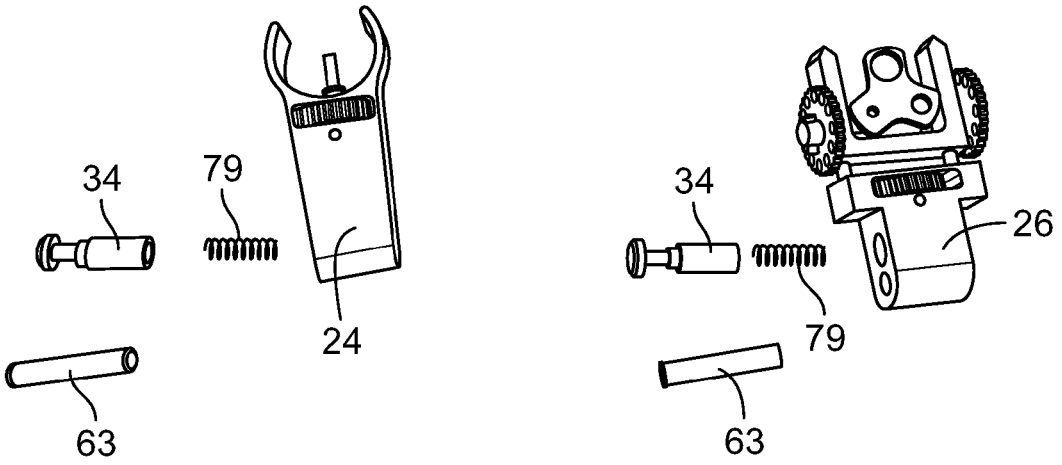
FIG. 25 is a view of components of an integrated rail and sight system of the invention.

Referring to FIG. 25, there are depicted components of the integrated rail and sight assembly 14 that have been described previously. In one embodiment, the integrated rail and sight assembly 14 includes a rail 22 used for mounting firearm accessories, including optics, lights, sights, lasers and the like. The integrated rail and sight assembly 14 may also include a front sight 24 that is pinned to a front end of the rail through the use of a pin 63. The pin 63 also permits the front sight to pivot from a flipped up position to a flipped down position. The pin 63 also permits the front sight 24 to be removed from the rail 22. The integrated rail and sight assembly 14 and specifically the front sight 24 also includes a plunger 34 that is operatively mounted to the front sight and a spring 79 that permits the plunger to move relative to the front sight. As stated above, the plunger and spring permit the front sight to be locked or held in position in either the flipped up position or in the flipped down position relative to the rail. As shown in the figure, the front sight further includes a sight post that may be adjusted vertically through the use of the elevation knob. The integrated rail and sight assembly 14 may also include a rear sight 26 that is also pinned to the rail 22 through the use of the pin 63. The pin 63 also permits the rear sight to pivot from a flipped up position to a flipped down position. The pin 63 also permits the rear sight 26 to be removed from the rail 22. The rear sight 26 also includes a plunger 34 that is operatively mounted to the rear sight and a spring 79 that permits the plunger to move relative to the rear sight. As stated above, the plunger and spring permit the rear sight to be locked or held in position in either the flipped up position or in the flipped down position relative to the rail. As shown in the figure, the rear sight may also include a tri-aperture, ambidextrous windage knobs, and an elevation knob, as described above.

Figure 26:
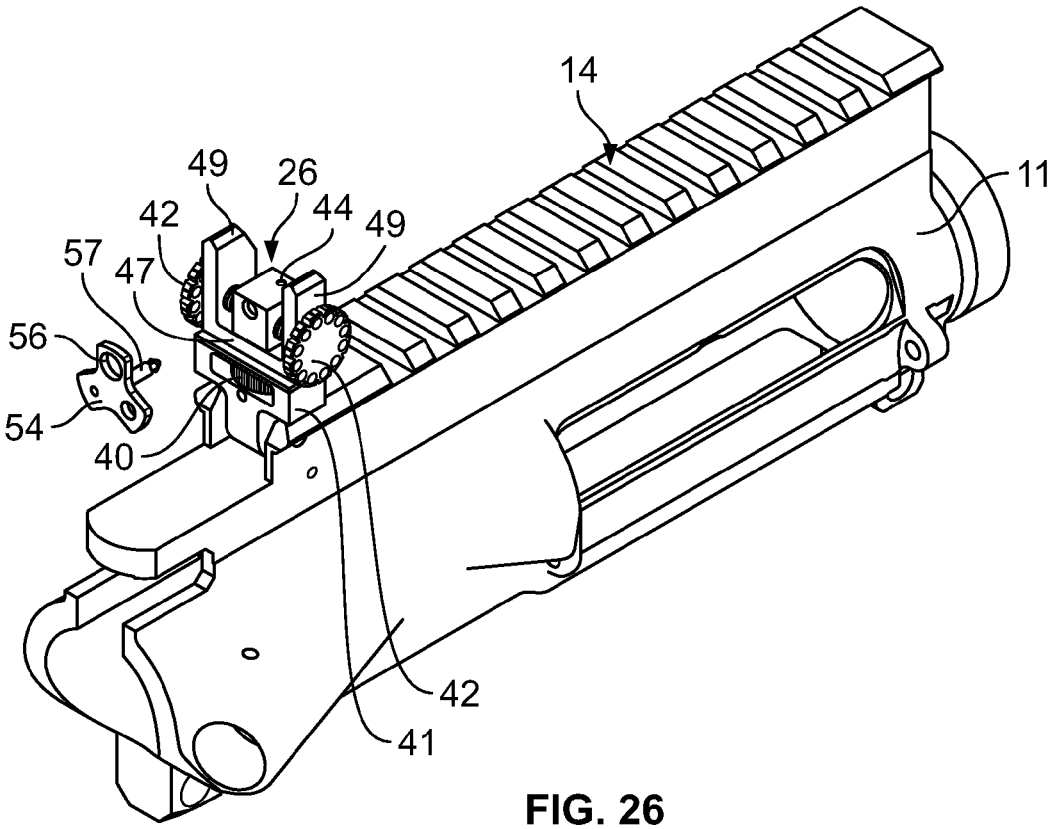
FIG. 26 is a partial perspective view of one embodiment of an integrated rail and sight system of the invention.
Figure 27:
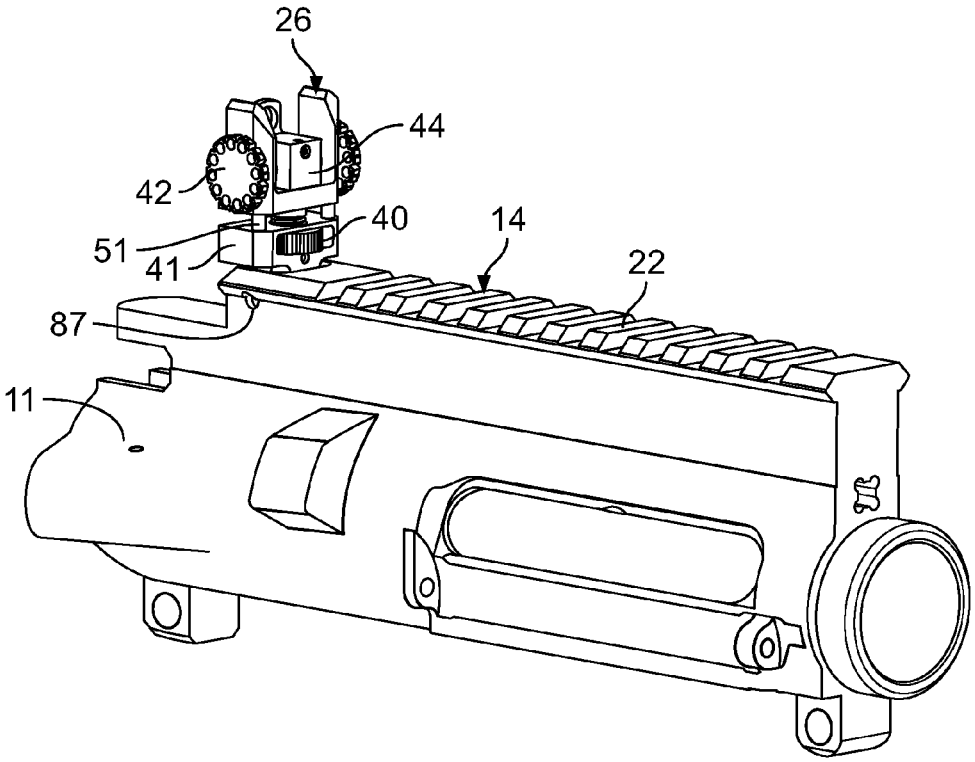
FIG. 27 is a partial perspective view of one embodiment of an integrated rail and sight system of the invention.
Figure 28:
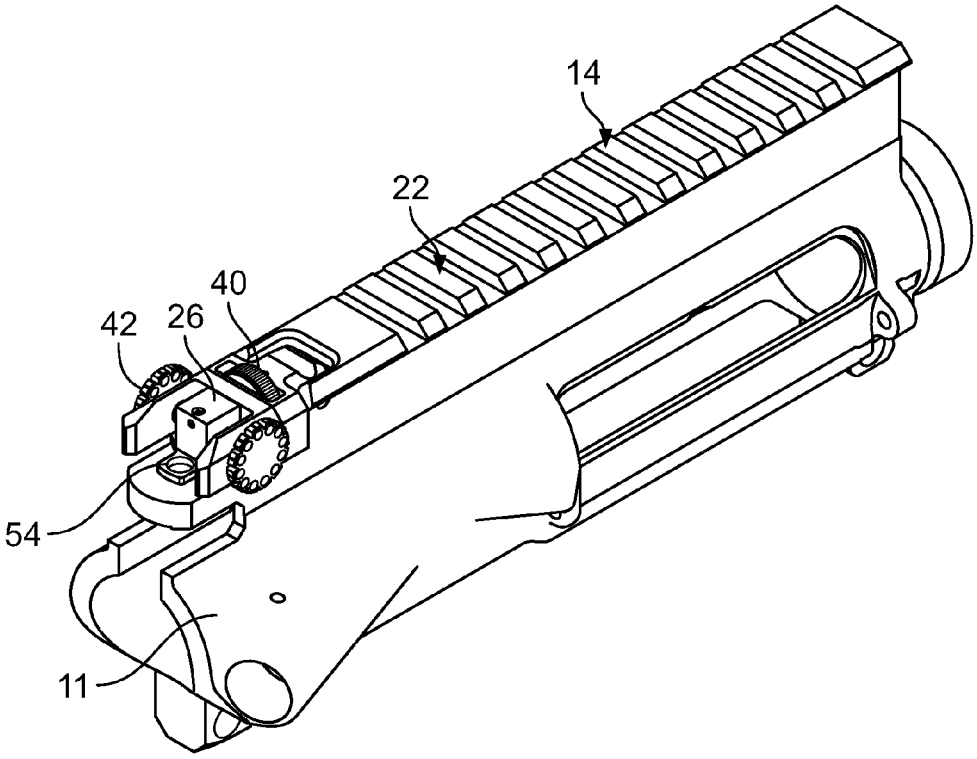
FIG. 28 is a partial perspective view of one embodiment of an integrated rail and sight system of the invention.
Figure 29:
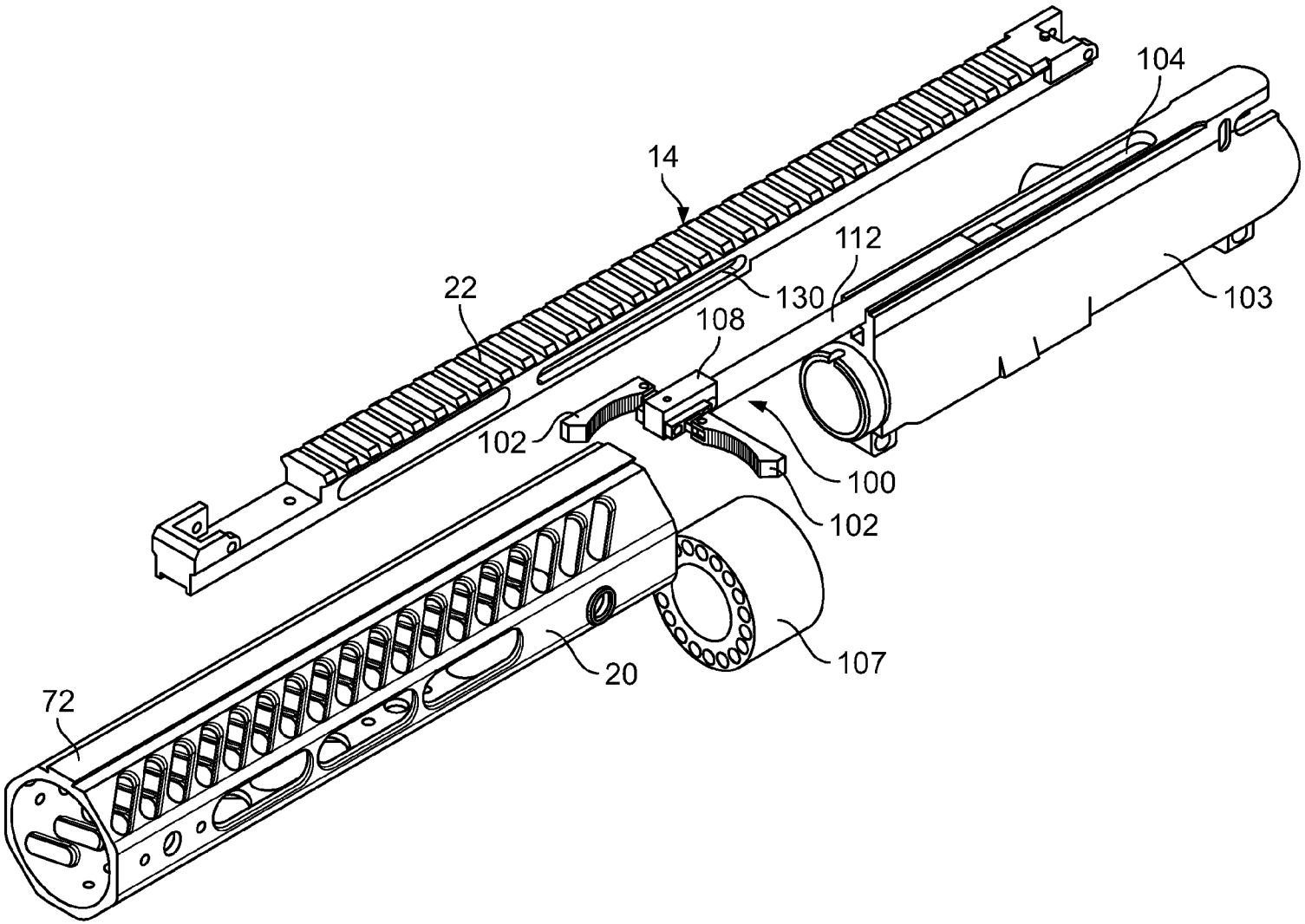
FIG. 29 is a perspective view of an exemplary side charging handle that may be used with the integrated rail and sight system of the invention.
Figure 30:
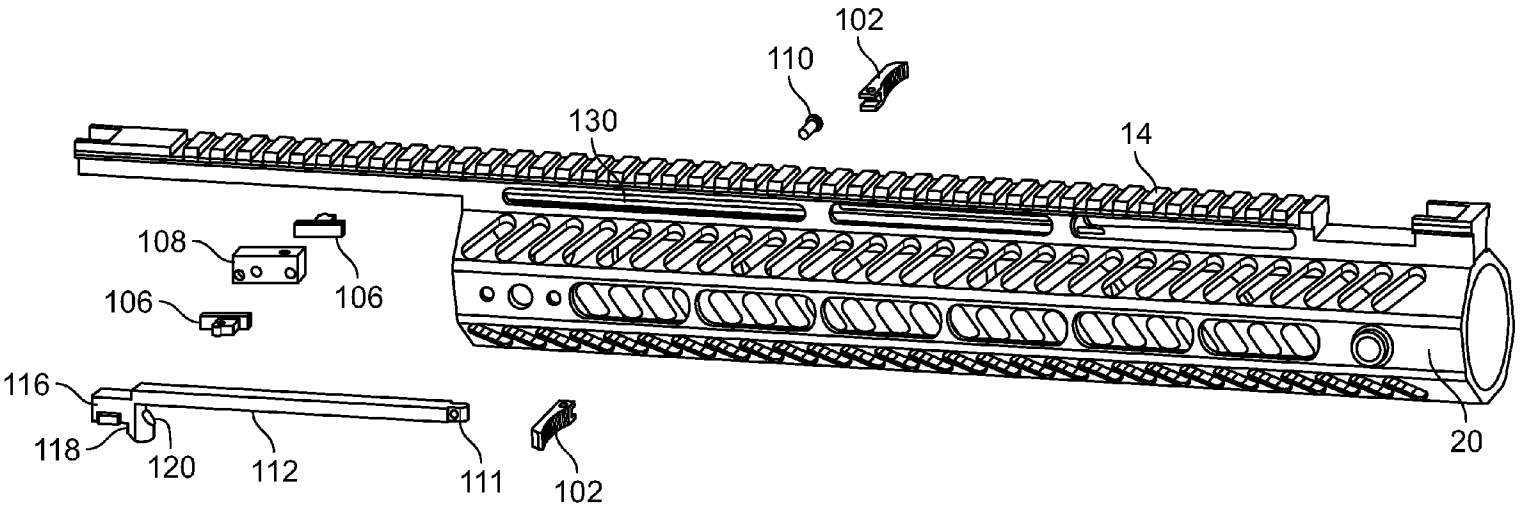
FIG. 30 is another perspective view of an exemplary side charging handle that may be used with the integrated rail and sight system of the invention.
Figure 31:
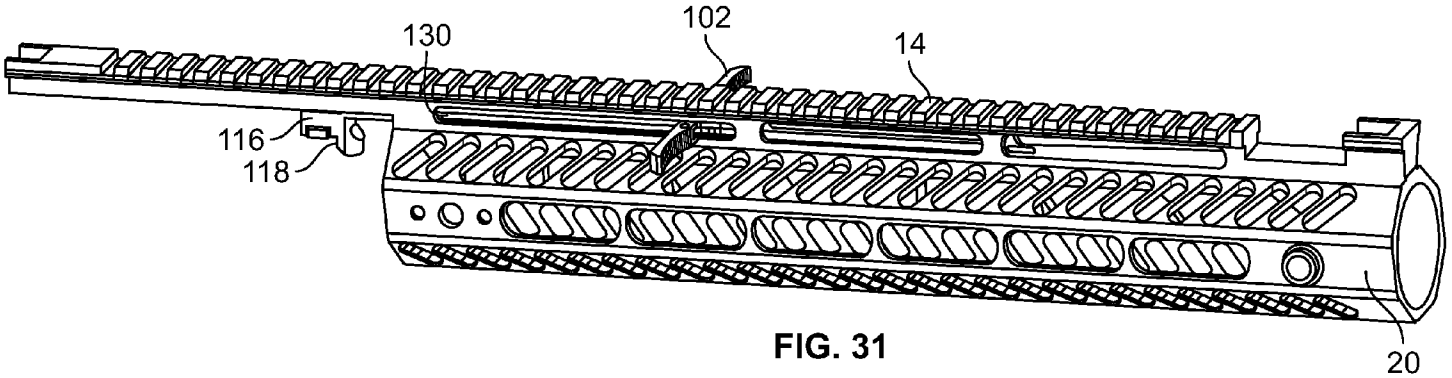
FIG. 31 is another perspective view of an exemplary side charging handle that may be used with the integrated rail and sight system of the invention.
Figure 32:
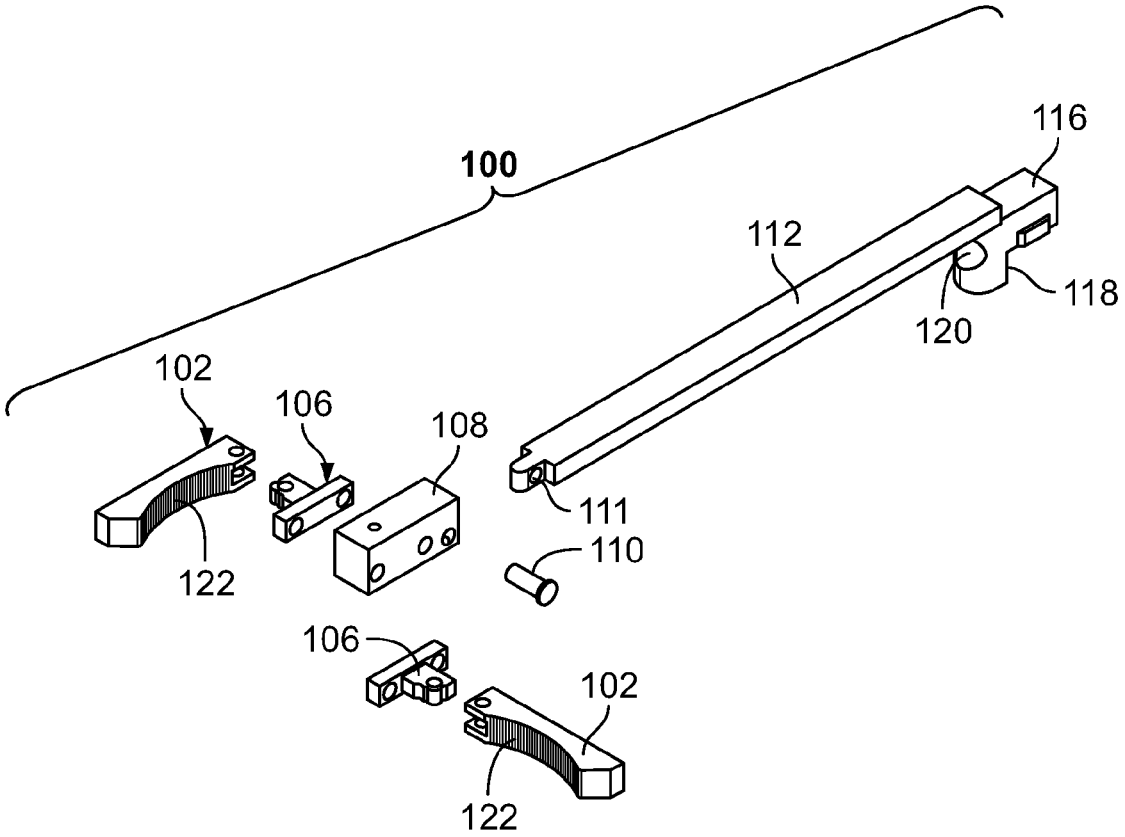
FIG. 32 is an exploded view of the components of the exemplary side charging handle that may be used with the integrated rail and sight system of the invention.

Referring to FIGS. 26-28, there are depicted additional images of the rear sight 26. As discussed, the rear sight may include an elevation knob 40 for adjusting the height of the rear sight. The elevation knob may be positioned within the elevation body 41 and is accessible through an opening. The rear sight 26 may also include ambidextrous windage knobs 42 for adjusting the rear sight in a lateral direction to account for wind conditions. The windage knobs operatively connect to and adjust the windage box 44. Connected to the windage box is a tri-aperture 54 that defines a plurality of different sized apertures 56. The tri-aperture is retained by a spring and ball bearing inside the windage box. The different size apertures permit the operator to rotate the rear sight aperture to a different sized aperture to account for different calibers of rounds fired through the firearm and for bullet drop. The windage knobs/wheels are mounted and held to a windage base 47 which also supports the windage box. The windage base also includes opposing and vertically extending brackets 49 that support the windage knobs. Connecting the windage base 47 to the elevation body 41 are vertically extending elevation pins 51. In one embodiment, two elevation pins operatively join the windage base 47 to the elevation body 41 and permit the vertical movement of the windage base relative to the elevation body. The pins 51 also keep the windage base from twisting relative to the elevation body. This permits the windage base to be held in place more securely thus improving the accuracy of the rear sight. The rear sight may be pinned to the rail 22 through the pin opening 87.

As shown in FIGS. 26 and 27, the rear sight is positioned in a flipped up position or a first position. As shown in FIG. 28, the rear sight is positioned in a flipped down position or a second position. In the flipped down position, the rear sight will lay flat with the rail 22 and will seat flush with or slightly below the top portion of the rail 22. As explained, this allows the rear sight to not interfere with any accessories mounted to the rail, but yet allows the rear sight to be connected to the rail and used in a flipped up position if desired.

Referring to FIGS. 29-32, an alternative embodiment of the firearm includes an ambidextrous side-charging handle assembly 100 that is mountable to and operable with the integrated rail and sight assembly 14 for charging the bolt assembly. The ambidextrous charging handle assembly 100 slidably mounts to the upper receiver and between the upper receiver and the underside of the integrated rail and sight assembly 14. The charging handle assembly 100 may include a pair of opposing ears 102 that function as a charging lever. The ears extend outwardly from both sides of the firearm and can be operated by either hand to charge the firearm, thereby creating an ambidextrous charging handle assembly. The charging handle assembly 100 will mount to an elongated channel 104 formed in the top side of the upper receiver 103 and will slide along the upper receiver. The channel 104 may define a dovetail cut or similar cut that captures and holds down the charging handle assembly 100. Unlike traditional charging handles that are located at the rear of the firearm, the charging handle is located forward on the firearm. A barrel nut 107 may be threadably mounted to the end of the upper receiver 103 for mounting a barrel, not shown, to the upper receiver 103.

With respect to the charging handle assembly, the opposing ears 102 may be pinned to opposite sides of a charging lever block 106. Each lever block 106 may be attached to opposing sides of a charging handle block 108. The charging handle block 108 may be pinned through the use of pin 110 to a hole 111 in a charging handle operating rod 112. The charging handle rod 112 defines an elongated body having an end 116 that defines a contact surface 118 configured to operatively contact and engage the bolt carrier. The end 116 defines a hole 120 that extends through the end. The gas operating tube may extend through the hole 120.

The opposing ears 102 may define a gripping surface 122 and may be folded against the side of the firearm when not in use. The opposing ears permit ambidextrous use of the charging handle. The charging handle 100 is non-reciprocating. The charging handle is not affixed to the bolt carrier and only operatively connected to the bolt carrier so the charging handle does not run back and forth when the firearm cycles. In other words, in the exemplary embodiment, the charging handle does not serve as a forward assist to the bolt carrier. The opposing ears 102 may extend through opposing, elongated slots 130 formed in the sides of the integrated rail and sight assembly 14. The elongated slots are located immediately beneath the top rail 22 of the rail and sight assembly. The elongated slots are sufficiently long so as to permit the ears to freely travel back and forth along the slots at least the same distance of travel as the bolt carrier does when the operator charges the firearm.

With the integrated rail and sight assembly 14 that is removable from the firearm, an operator can easily and quickly remove the front and rear sights and replace them with different types of sights. In an alternative aspect, the operator could remove the integrated rail and sight assembly 14 and replace it with another integrated rail and sight assembly having different sights already mounted to the rail. With the invention, the flexibility of the interchangeability of the sights creates numerous possibilities with the firearm. For example, an operator using the firearm for long range shooting with long range optics can quickly and easily change out the integrated rail and sight assembly with another integrated rail and sight assembly having sights for close quarter combat. The same is true for operators who use the firearm for competition shooting and who need to quickly change the sights for the next targets.

It should be understood that the integrated rail and sight assembly 14 described herein can be scaled down and mounted to other firearms, such as handguns, including the model 1911 handgun and other handguns. All the teachings and descriptions herein have complete application with a handgun. In one embodiment, the handgun may be manufactured with a dovetail cut in the top frame or slide of the handgun. The dovetail cut may be configured to receive the mating dovetail cut on the integrated rail and sight assembly to thereby permit the slidable mounting of the integrated rail and sight assembly to the top of the handgun. With the integrated rail and sight assembly, the operator who needs to quickly change out the sights needed for a particular competition target shooting will be able to do so. For example, if an operator needs to switch between a three-dot sight, a dot and bar sight, an express-style sight, a bright sight or a big dot sight, the operator only needs to slide off the integrated rail and sight assembly and slide onto the handgun the assembly containing the desired sights. Significantly, with an integrated rail and sight assembly of the invention, now only one handgun, rifle, long gun, or shot gun, etc., is needed for multiple types of shooting competitions because the operator only needs to change out the integrated rail and sight assembly to make the firearm usable for other types of shooting conditions or competitions.

Each of the various embodiments described herein may contain any components, structures, or other features of any of the other embodiments described herein, including any variations, additional features, or alternative embodiments described herein, whether or not illustrated in the drawing figures.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention.

What is claimed is:

1. A firearm comprising:

a lower receiver, an upper receiver mounted to the lower receiver, a barrel mounted to the upper receiver, a handguard surrounding at least part of the barrel, an elongated detachable mounting rail that slides onto a top surface of the upper receiver and onto a top surface of the handguard, and at least one sight mounted to the detachable mounting rail, the at least one sight movable between a flipped-up position to a flipped-down position, wherein the at least one sight includes a box for mounting a rotatable tri-aperture, the tri-aperture defining a central post extending outwardly from a planar surface that defines three spaced apart holes, the central post defining a plurality of spherical radii spaced around the central post, the box defining an opening that receives the central post of the tri-aperture, a spring urged spherical ball is located within the opening in the box, the spring urged spherical ball configured to operatively engage each of the plurality of spaced apart radii when the tri-aperture is rotated and also permit the tri-aperture to be detached from the at least one sight.

2. The firearm of claim 1, further comprising two sights mounted to the detachable mounting rail, a first sight mounted near a first end of the detachable mounting rail, and a second sight mounted near a second end of the detachable mounting rail.

3. The firearm of claim 2, wherein each sight is movable between a first position and a second position.

4. The firearm of claim 1, further comprising an ambidextrous charging handle mounted to the upper receiver and to an underside of the detachable mounting rail.

5. The firearm of claim 4, wherein the charging handle includes foldable ears that extend through side walls of the detachable mounting rail.

6. The firearm of claim 1, wherein the detachable mounting rail defines an elongated dovetail cut on an underside of the mounting rail for use in mounting the mounting rail to the upper receiver and the handguard.

7. The firearm of claim 2, wherein the detachable mounting rail defines an upper top surface, and wherein the first and second sights are positioned entirely below the upper top surface when the first and second sights are in a flipped-down position.

8. The firearm of claim 1, wherein the at least one sight further includes a plunger and a spring that permit the at least one sight to be held in position in either the flipped-up position or in the flipped-down position relative to the elongated mounting rail.

9. The firearm of claim 1, wherein the at least one sight further includes an ambidextrous windage knob and an elevation knob.

10. A firearm comprising:

a lower receiver, an upper receiver mounted to the lower receiver, a barrel mounted to the upper receiver, a handguard surrounding at least part of the barrel, an elongated detachable mounting rail slidably mounted to a top surface of the upper at least one sight mounted to the detachable mounting rail, the at least one sight movable between a flipped-up position to a flipped-down position, and an ambidextrous charging handle mounted to the upper receiver and to an underside of the detachable mounting rail, the charging handle including foldable ears that extend through side walls of the detachable mounting rail.

11. The firearm of claim 10, further comprising two sights mounted to the detachable mounting rail, a first sight mounted near a first end of the detachable mounting rail, and a second sight mounted near a second end of the detachable mounting rail.

12. The firearm of claim 11, wherein each sight is movable between a flipped-up position to a flipped-down position.

13. The firearm of claim 10, wherein the at least one sight includes a rotatable tri-aperture that is detachable.

14. The firearm of claim 12, wherein the detachable mounting rail defines an upper top surface, and wherein each sight is positioned entirely below the upper top surface when each sight is in a flipped-down position.

15. The firearm of claim 10, wherein the receiver is a slide, the slide defining a top surface that further includes an elongated dovetail cut for receiving the elongated detachable mounting rail.

16. The firearm of claim 10, wherein the at least one sight further includes an ambidextrous windage knob and an elevation knob.

17. The firearm of claim 10, further comprising a plunger that permits the at least one sight to be held in position in either the flipped-up position or in the flipped-down position relative to the elongated mounting rail.

18. The firearm of claim 17, wherein the at least one sight defines a half-moon shaped portion for receiving the plunger to permit the at least one sight to be held in the flipped-down position relative to the elongated mounting rail.

19. The firearm of claim 10, further comprising a pin that connects the at least one sight to the elongated mounting rail and also holds into place the elongated mounting rail relative to the upper receiver.

* * * * *